United States Patent [19]

Voigt, Jr.

[11] Patent Number: 4,543,220

[45] Date of Patent: Sep. 24, 1985

[54] PROCESS FOR UNITARY SHAPED-CHARGE STRUCTURE

[75] Inventor: H. William Voigt, Jr., Wharton, N.J.

[73] Assignee: The United States of America as represented by the Secretary of the Army, Washington, D.C.

[21] Appl. No.: 600,240

[22] Filed: Apr. 16, 1984

[51] Int. Cl.[4] ..... C06B 21/00

[52] U.S. Cl. ..... 264/3 C; 264/3 R; 102/306; 149/19.4

[58] Field of Search ..... 264/3 R, 3 B, 3 C; 102/306; 149/19.4, 19.9

[56] References Cited

U.S. PATENT DOCUMENTS

| | | | |
|---|---|---|---|
| 3,722,410 | 3/1973 | Hurst | 102/306 X |
| 3,907,619 | 9/1975 | Elrick | 264/3 C X |
| 4,011,818 | 3/1977 | Stosz, Jr. | 102/481 |
| 4,110,136 | 8/1978 | Hershkowitz | 149/47 |
| 4,116,734 | 9/1978 | Perrault et al. | 149/19.9 X |
| 4,284,442 | 8/1981 | Voigt, Jr. | 149/19.4 |
| 4,297,946 | 11/1981 | Paton et al. | 264/3 A |

*Primary Examiner*—Peter A. Nelson

*Attorney, Agent, or Firm*—Anthony T. Lane; Robert P. Gibson; Edward F. Costigan

[57] ABSTRACT

An improved process of making shaped explosives for a shaped charge device. In the process, the crystalline explosive is divided into two parts. One part of the explosive is coated with a liquid prepolymer, and the second part is coated with a liquid curing agent. The two parts are combined, shaped, and consolidated at room temperature under a pressure of 20000 psi for a dwell time of one minute to produce a shaped explosive.

9 Claims, No Drawings

PROCESS FOR UNITARY SHAPED-CHARGE STRUCTURE

GOVERNMENTAL INTEREST

The invention described herein may be manufactured, used and licensed by or for the Government for Governmental purposes without payment to me of any royalties thereon.

BACKGROUND OF INVENTION

1. Field of Invention

This invention relates to a process of making shaped-charge explosives.

More particularly, this invention relates to an improved process of making a shaped-charge explosive having a density approaching the crystalline density of the explosive itself in a more efficient and effective manner without the application of heat.

2. Description of Prior Art

A conventional shaped charge is a device for producing a penetrating jet from a liner by the detonation of an explosive surrounding the liner. The greater the pressure produced in the device, the greater is the effect of the penetrating jet. This action is initiated by the explosive, the higher the density, the greater the pressure produced upon detonation. The optimum in pressure is realized when the shaped explosive charge approaches the crystal density of the explosive itself. In practice, the explosive which fits the shaped charge device is mixed with a solid elastomer, shaped, and consolidated into a unitary piece by means of 30000 psi of pressure. The object is to produce a shaped charge explosive element having a density approaching the crystal density of the explosive itself. However, during the above cited processing, there is a need to heat the explosive mix, the mold, and the dies of the press in order to attain the best results with respect to density. There is also a need for greater pressures in the pressing stage of the process to insure the density desired is attained. The heating stage is not only time-consuming but a costly part of the process. What is needed in the art is a room temperature procedure of relatively low pressure which will still attain and maintain the density desired in the explosive charge.

SUMMARY OF INVENTION

It is therefore an object of this invention to provide an improved process for making shaped-charge explosives having a density approaching the crystalline density of the high-explosive itself.

Another object of this invention is to provide a process which may be used at room temperature and relatively lower pressure to produce a shaped-charge having a high order of density.

A further object is to provide a more efficient and effective process of making shaped-charge explosive which is economical in cost and time.

Other objects and many of the attendant advantages of this invention will become better understood from a reading of the following detailed description.

In general, the master blend of HMX, also known as cyclotetramethylene tetranitramine is divided into two parts, one of which is mixed with a liquid prepolymer and the other of which is mixed with a liquid curing agent. The parts are then combined, shaped, and consolidated with pressure to produce one solid unitary piece representing a shaped-charge explosive for use in the shaped-charge device. The entire procedure is carried out at comparatively lower pressure, and at room temperatures without heat treatment which is costly in time and costs.

In particular, the master blend of HMX is divided into a first and second part. The first part is mixed and coated with a liquid prepolymer which is a polyfunctional isocyanate based on 4,4'-diphenylmethane diisocyanate or tolylene diisocyanate which has been partially reacted with castor oil or a polyol based on castor oil. The second part is mixed and coated with a liquid, mild curing agent such as castor-oil or polyol. The castor oil is a triglyceride ester of fatty acids. Ninety percent of the fatty acid content is ricinoleic acid. Castor oil contains an 18 carbon hydroxylated fatty acid with one double bond. The first and second parts are combined in one free flowing mass added to a mold and shaped in the mold. The mass is consolidated into one solid unitary piece or billet with about 20000 pounds per square inch of pressure for a dwell time of about 1 minute. The pressed billet develops sufficient hardness and initial compressive strength for immediate removal from the mold by pressing. This produces a unitary machinable piece having a density approaching the crystalline density of the HMX itself. Maximum hardness of the billet, resulting from complete hardening of the binder, is developed in about two days.

During pressing, the liquid prepolymer and the liquid curing agent as coatings combine and react to form a urethane binder, present in an amount between about 1 to 10 percent by weight based on the total weight of the resulting product. The preferred amount of binder is about 4 percent by weight. The above liquids upon combination at room temperature chemically react to form a cross-linked, solid urethane polymer or elastomer. The urethane polymers result from the reaction of hydroxyl groups in castor oil with the isocyanate groups in the prepolymer. The liquid prepolymer is the reaction product of a castor oil or castor oil based polyol with excess polyfunctional isocyanates, and is capable of further reaction with castor oil or polyols to form the solid elastomer. The total binder weight is the combined weight of the liquid prepolymer and polyol on a stoichiometric basis.

Castor oil or polyols derived from castor oil, of varying functionality, may be used in the present process. The latter polyols differ chemically from polyols of the polyester or polyether types commonly used in the preparation of urethane polymers. The curing agent preferred for use in the present process have fewer ester groups than the polyesters and contain no ether linkages as found in the polyols of the polyether types. The polyols used in the present process are more hydrolytically stable than the cited polyols of the polyester or polyether types. The polyols used are designated Polycin, while the preferred castor oil is DB Castor Oil: both of these chemicals are products of Cas Chem. Inc., Bayonne, N.J.

Various designated Vorites, products of Cas Chem. Inc., Bayonne, N.J., also of varying functionality, may be used in the present process. The prepolymers may be present to produce the binder in an amount between about 0.38 percent to about 3.80 percent by weight based on the weight of the total mass. For example, for a 4% total binder, 1.52 percent by weight of Vorite 729 is utilized with the castor oil polyol agent being present in an amount of about 2.48 percent by weight.

The liquid prepolymer contains 4,4'-diphenylmethane diissocyanate or tolylene diisocyanate, which has been partially reacted with castor oil or polyol, but which has an excess of isocyanate groups for further reaction with the liquid curing agent to produce a solid polymer. Due to the use of the liquid prepolymer, the process is safe to use because of the greatly reduced vapor hazard. It also simplifies the process because of the capability of the liquids to cure at room temperature.

The pressure of consolidation is about 20000 pounds per square inch for a dwell time of 1 to 2 minutes.

The press used was a single action conventional press, Model RT 16A, of the Enerpac Company, Butler, Wis.

The master blend of HMX is made of 75 percent of particles having an average size of about 170μ and 25 percent having an average size of about 10μ. The explosive may be present in an amount between about 90 to 99 percent by weight. The preferred amount is 96 percent by weight based on the weight of the product mass.

The density of the unitary piece is advantageously effected by using 0.1 to 0.2 percent by weight of $Al_2O_3$ based on the weight of the HMX. This material, which has a particle size of about 0.01μ, aids in making the density desired attainable in the final product.

DESCRIPTION OF PREFERRED EMBODIMENT

EXAMPLE 1

A. 25 gms of HMX having a particle size of about 10μ (LX-04) was coated by mixing with 10 mls of a 0.1 percent ethanol solution of polyvinylpyrrolidone. The resulting mass was air-dried. At this point, 25 gms of the resulting coated mix was further blended with 0.025 gms of $Al_2O_3$ having a particle size of 0.01μM by roll-blending. The resulting blend was mixed with 75 gms of HMX having an average particle size of 170μ (Class I) to give a Master Blend of HMX for further processing.

B. 48 gms of the above Master Blend was coated by mixing with 1.52 gms of a liquid prepolymer known as Voritel 729, a product of Cas Chem, Inc., Bayonne, N.J., dissolved in 10 mls of methylene chloride. The damp coated blend was then dried at room temperature overnight. An additional 1.5 mls of methylene chloride was stirred-in, and the mixture dried, to produce a uniform material having a soft free-flowing physical condition. This coated-explosive blend may be stored indefinitely.

C. Another 48 gms of the above cited Master Blend from the pre-conditioning in paragraph A was coated by mixing with a solution of 2.48 gms of castor oil dissolved in 10 mls of methylene chloride. This resulted in a damp mixture which was dried overnight at room temperature and produced a soft, uniform, free-flowing mass of relatively large crystal of coated HMX surrounded by fine coated particles. This coated-explosive blend may be stored indefinitely.

D. The blends produced by the procedures set forth in paragraphs B and C were further blended together in end over end tumbling using a double cone blender. The resulting mix had a blue tint (indicating uniform mixing) and was dried over a steam bath for 1 hour to drive off any remaining methylene chloride. At this point, the resulting mixture was a free flowing powder.

E. The free-flowing powder was then shaped in a mold and consolidated into a unitary piece by a single-action conventional press, applying about 20000 pounds per square inch for a dwell time of about 1 minute producing a solid unitary shaped charge having sufficient green strength to be ejected immediately from the mold. The entire pressing operation was carried out at room temperature.

Utilizing the procedure set forth in Example 1, shaped charges were produced and tested for density and Shore D durometer Hardness. The results of some of these test were as follows:

TABLE 1

| Ram Pressure A. 20000 psi | | Hardness Durometer Shore D | |
|---|---|---|---|
| Height/Diameter Ratio | Density | Initial | Final 2 Days Later |
| 0.605 | 1.793 | 47 | 53 |
| 0.908 | 1.793 | 47 | 53 |

The maximum hardness of the pellets was reached within 2 days to a 53 Shore D Hardness value, indicating full curing at room temperature. Results on longer terms indicated that no further strength was reached after 2 days. The table indicates that the liquid prepolymer/polyol binder system allows one to increase the height of the pellet and yet obtain uniformly high and unchanging density. This is not possible with the conventional procedure which uses a tough thermosetting polyurethane elastomer binder which is not in the liquid state. The formulas for figuring the constituents of Vorite 729 are:

$$\frac{42 \text{ mw} \times 100}{\% \text{ NCO } (21.1)} = \text{equivalent weight of the prepolymer}$$

$$\frac{56.1 \text{ mw (KOH)} \times 100}{\text{OH value } (16.3)} = \text{equivalent weight of polyol or castor oil}$$

It has been found that by utilizing the above pressure that a shaped-charge explosive is produced which has a density approaching the crystalline density of HMX itself. The present procedures may also be used to produce a shaped charge of RDX known as cyclotrimethylene trinitramine, and PETN also known as pentaerythritol tetranitrate. The entire procedure is carried out at room temperature for savings in time and costs. In comparison to the present art, relatively lower pressures are used in the pressing stage of the procedure.

I claim:

1. In an improved process of making a shaped-charge explosive comprising mixing an explosive with a thermoplastic polymer, shaping, and pressing the shaped explosive into a unitary structure wherein the improvement consisting essentially of dividing said explosive into a first and second part, coating said first part with a liquid urethane prepolymer, coating said second part with a mild liquid curing agent, combining said first and second coated parts at room temperature, shaping said combined parts at room temperature by pressing said shaped explosive into a unitary piece at room temperature with about 20000 pounds per square inch for a dwell time of about 1 minute.

2. The process of claim 1 wherein said explosive is HMX and is a mixture of 75 percent by weight having an average particle size of about 170μ and 25 percent by weight having an average particle size of about 10μ.

3. The process of claim 2 wherein about 0.1 to 0.2 percent of $Al_2O_3$, having a particle size of substantially about 0.01 microns, is blended with said explosive prior to division into said parts.

4. The process of claim 1 wherein said curing agent is dissolved in methylene chloride prior to said mixing.

5. The process of claim 1 wherein said liquid urethane prepolymer is dissolved in methylene chloride prior to said mixing.

6. The process of claim 4 wherein said curing agent is castor oil.

7. The process of claim 4 wherein said curing agent is a polyol based on castor oil.

8. The process of claim 1 wherein said prepolymer contains partially reacted tolyene diisocyanate.

9. The process of claim 1 wherein said prepolymer contains partially reacted 4,4'-diphenylmethane diisocyanate.

* * * * *